US007905795B1

(12) United States Patent
Nuno et al.

(10) Patent No.: US 7,905,795 B1
(45) Date of Patent: Mar. 15, 2011

(54) UNITARY BROADHEAD WITH LASER WELDED FERRULE

(75) Inventors: Gustavo Nuno, Murrieta, CA (US); Edward Comber, Wildomar, CA (US); Randall P Bonner, Canyon Lake, CA (US)

(73) Assignee: Acropolis Engineering, Temecula, CA (US)

( * ) Notice: Subject to any disclaimer, the term of this patent is extended or adjusted under 35 U.S.C. 154(b) by 574 days.

(21) Appl. No.: 12/006,604

(22) Filed: Jan. 4, 2008

Related U.S. Application Data

(60) Provisional application No. 60/878,951, filed on Jan. 5, 2007.

(51) Int. Cl.
*F42B 6/08* (2006.01)

(52) U.S. Cl. ..... 473/253; 473/584

(58) Field of Classification Search ..... 446/582–584; 473/582–584
See application file for complete search history.

(56) References Cited

U.S. PATENT DOCUMENTS

| | | | | |
|---|---|---|---|---|
| 4,505,482 | A * | 3/1985 | Martin, Sr. | 473/583 |
| 6,290,903 | B1 | 9/2001 | Grace, Jr. et al. | |
| 6,605,012 | B2 * | 8/2003 | Muller | 473/584 |
| 6,726,581 | B2 * | 4/2004 | Muller | 473/583 |
| 6,939,258 | B2 * | 9/2005 | Muller | 473/583 |
| 7,232,390 | B2 * | 6/2007 | Mizek et al. | 473/583 |
| 2005/0181898 | A1 | 8/2005 | Muller | |
| 2006/0030439 | A1 * | 2/2006 | Muller | 473/583 |
| 2007/0228022 | A1 * | 10/2007 | Muller | 219/121.63 |

* cited by examiner

*Primary Examiner* — Gene Kim
*Assistant Examiner* — Scott Young
(74) *Attorney, Agent, or Firm* — Warren Coon, Patent Agent

(57) ABSTRACT

A chisel-type broadhead comprises a threaded ferrule laser welded to multiple blades. The blades are welded from both sides. The blades are welded to each other and to the ferrule. The ferrule and blades are configured to provide maximum impact strength to the broadhead. An optional feature enabling the broadhead ferrule threads to be tightened to the arrowshaft is provided. An improved method of welding the blades to the ferrule is provided.

16 Claims, 12 Drawing Sheets

UNITARY BROADHEAD WITH LASER WELDED FERRULE

CROSS REFERENCE TO RELATED APPLICATIONS

This application claims the benefit of Provisional Application 60/878,951, filed Jan. 5, 2007

FIELD OF THE INVENTION

The present invention relates to archery hunting equipment. More particularly, the invention relates to a broadhead arrow point for an arrow, and a method of manufacturing the same.

BACKGROUND OF THE INVENTION

Typically, a broadhead arrow point, or simply broadhead, is an assembly of blades arranged around a central axial shaft or ferrule for attachment to an arrowshaft to form a complete arrow for use in target archery or hunting. The broadhead may be detachable for replacement in case it becomes dull or damaged.

The broadhead applies a large force to the target upon striking it and so must be as strong as possible within the constraints of mass and aerodynamic shape. Existing design broadheads frequently break upon impact with the target so there is a need for an improved stronger broadhead.

Detachable broadheads can become loose from the arrowshaft, or can become detached from the shaft entirely, leading to erratic flight performance or disintegration in flight, which would render the arrow ineffective or lead to something other than the targeted object being impacted, so there is a need for a more secure attachment between the broadhead and the arrowshaft. Additionally, broadheads comprising multiple parts that are inserted together and held by screws or clamps may become loose or fall in handling or in use and parts may be lost rendering the broadhead useless. Broadheads with moving parts, such as cams and swivels may not operate correctly in field conditions outside in weather and mud. Broadheads with separate removable ferrules, sometimes referred to as modular broadheads, may become loose in handling. So there is a need for a unitary broadhead with minimum or no moving parts.

Broadheads are costly to manufacture, and there is constant market pressure to produce an effective high performance broadhead with reduced manufacturing costs.

There have been many broadhead designs developed over the years, yet there are none previously known that optimally combine strength, reliability, and cost. Prior art designs have had detachable blades, multiple threaded ferrules with caps, two piece ferrules, slotted blades, or other features that added to the expense or detracted from the strength and reliability of the broadhead.

For example, Muller in US Published Patent Application 20050181898 Unitary Broadhead Blade Unit discloses an injection molded modular blade unit with separate ferrule which requires a pair of threaded connections; one between the ferrule and the arrowshaft and another between the blade unit and the ferrule. By requiring the blades to be molded, either as an assembly of blades or separably molded and then fused together, and then mated to the ferrule, the configuration results in a design that has several unnecessary potential points of weakness, since sintered metal typically sacrifices some strength compared to sheet or foil stock.

Similar disadvantages exist in U.S. Pat. No. 6,726,581, also to Muller, which also specifies a separate ferrule, and U.S. Pat. No. 6,290,903 to Grace, Jr et al which specifies a molded blade unit of sintered powder.

Thus there is a need for an improved broadhead. The object of the present invention is to overcome these shortcomings and present a strong, economical, and rugged broadhead.

SUMMARY OF THE INVENTION

In accordance with a preferred embodiment of the invention, a broadhead includes a threaded ferrule portion permanently attached to multiple blades. At the distal end of the broadhead, the blades are permanently attached directly together. At the proximal end of the blades, the blades are permanently attached to the ferrule portion. Between the proximal and distal ends, the blades are further permanently attached to the ferrule portion and to each other.

In the discussion to follow, "ferrule" will refer to the separate ferrule piece part before assembly into the broadhead, and "ferrule portion" will refer to the portion of the broadhead arrowpoint (after assembly) comprising the ferrule.

Preferably, the ferrule portion has a proximal end with a threaded portion to receive the mating portion of the arrowshaft for attachment to the shaft. Typically, an arrowshaft comprises an elongated shaft with fletches or vanes at the proximal end and a threaded distal end attachable to the broadhead. Distally of the threaded portion of the ferrule portion there may be one or more conical or spherical contacting portions to receive the blades for permanent attachment. The conical or spherical portions help transmit the axial load imposed by the blades upon the shaft at target impact. By using a conical or spherical portion, the load is transmitted partially by compression between the blades and ferrule portion resulting in a stronger unit than if the load were transmitted by only shear at the blade to ferrule weld attachment.

Typically, the ferrule portion diameter is selected to a predetermined value at various points along its length to achieve a predetermined design value for mass for the broadhead. Typically, the desired mass is about 100 grams, but other design values may be desirable for different applications.

Preferably in accordance with the invention, each blade is formed of stainless steel, preferably 400 Series stainless steel, which may be heat treated for hardness before or after attachment to the ferrule. Preferably the blades are stamped from 416 or 420 series stainless steel. The edges of the blades are beveled where they are attached together to reduce the gap which may be filled upon attachment. Preferably, the blades are individually heat treated to achieve the desired strength and hardness before attachment to the ferrule.

In the preferred embodiment, there are three blades attached symmetrically at intervals around a threaded ferrule portion. The blades are welded to the ferrule portion and to each other by laser welding techniques which are well known in the art. Preferably the welds would be applied at the distal end, where the three blades join together directly, at the blade proximal end where each blade contacts the ferrule portion, and in a middle zone where the blades contact each other and also contact the ferrule portion. In accordance with the invention, the welding laser energy is applied to both sides of a given blade. Preferably the welds may be done to both sides simultaneously. Preferably the laser welds are a series of spot welds which overlap to create a nearly continuous weld along each weld zone.

In accordance with the invention, the ferrule portion has a threaded proximal portion, a proximal shaft extension portion, a proximal conical or spherical portion, a distal shaft extension portion, and a distal conical or spherical portion. The threaded proximal portion may be male or female threads, but is preferably a male thread and the thread on the arrowshaft is preferably female. The threaded portion of the broadhead is threaded into the mating threaded portion of the arrowshaft with sufficient tightening torque to remain firmly attached in use. The proximal conical or spherical portion may have a planar or annular portion contacting the corresponding distal portion of the arrowshaft.

In an optional embodiment, the proximal conical or spherical portion may have a square or hexagonal feature, or opposed flats to enable engagement with a tool to aid in fixing the broadhead securely to an arrowshaft with reduced chance of injury to the person assembling the broadhead to the arrowshaft while simultaneously allowing increased tightening torque to be applied to the arrowshaft-to-broadhead connection.

In accordance with the method aspects of the invention, the method includes stamping the blades from 400 series stainless steel sheet, fixturing them on a rotatable mandrel with a ferrule, spot welding them with a laser of approximately 1200 nM wavelength with peak power of 3 KW with a pulse duration of 3.3 milliseconds on one side of each blade to form welds of approximately 0.030 inches diameter. Tack welds are applied initially to hold the blade assembly and ferrule together for subsequent handling during welding. The blade unit is rotated to bring the next desired weld area under the working range distance of the laser so that the blade assembly may be similarly tack welded on each blade. The blade unit is then welded with power settings and pulse duration as above with a series of spot welds overlapping by 60 to 70 percent. Then the assembly is rotated on the mandrel one third of a turn (in the case of a three bladed broadhead) and welded again in similar fashion. Then it is rotated a further one third of a turn and welded again. Then in further accordance with the invented method, the welded assembly is removed from the mandrel, heat treated for 1.5 hours at 1800 degrees Fahrenheit in an inert atmosphere comprising Argon to harden them to approximately Rc 56, and stress relieved for 15 minutes at 900 degrees Fahrenheit in an Argon comprising inert atmosphere. Optionally the heat treatment may be in an oxidizing atmosphere to achieve a black oxide finish which would be advantageous in an application requiring camouflaging the user. The blades are sharpened by grinding at an angle of 60 degrees, and then lapped by conventional means, and then the broadhead is cleaned and packaged.

Optionally in addition the distal point of the broadhead may be welded from both sides of each blade simultaneously. In the case of a three bladed broadhead all three blades are welded together at the tip with welds directed from one, two or three directions as will be explained in detail later.

DETAILED DESCRIPTION OF THE INVENTION

Figure 1:
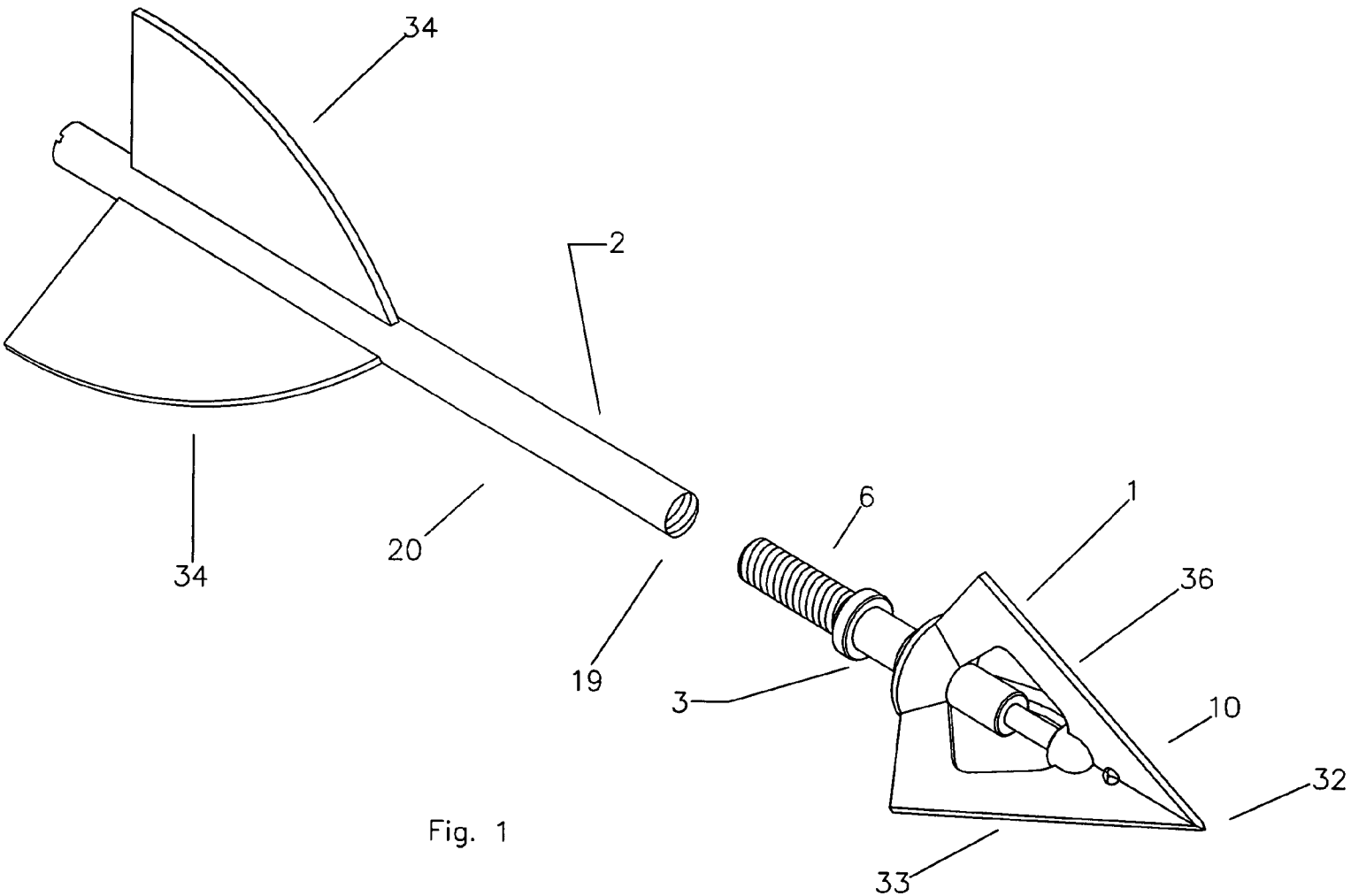
FIG. 1 is an exploded view of an arrow with arrowshaft and broadhead.
Figure 2:
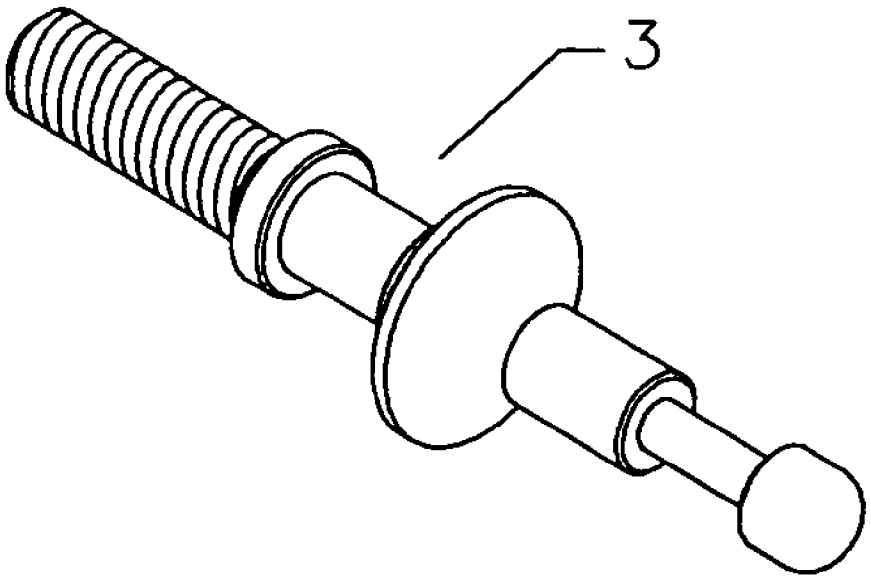
FIG. 2 is a ferrule used in the invented broadhead.

Referring now to the drawings, in FIG. 1 the invented broadhead 1 is shown in relation to an arrowshaft 2. Threads 6, shown as preferably male in broadhead 1 engage with threads 19 shown as preferably female of arrowshaft 2 to form arrow 20. Broadhead 1 comprises multiple blades 10 which form a blade assembly 33 which is attached to ferrule 3. Broadhead 1 comprises cutting edges 36. Arrowshaft 2 comprises fletches 34. FIG. 2 more clearly shows ferrule 3 which is conventional and known in the art and is optionally used in the invented broadhead 1.

Figure 3:
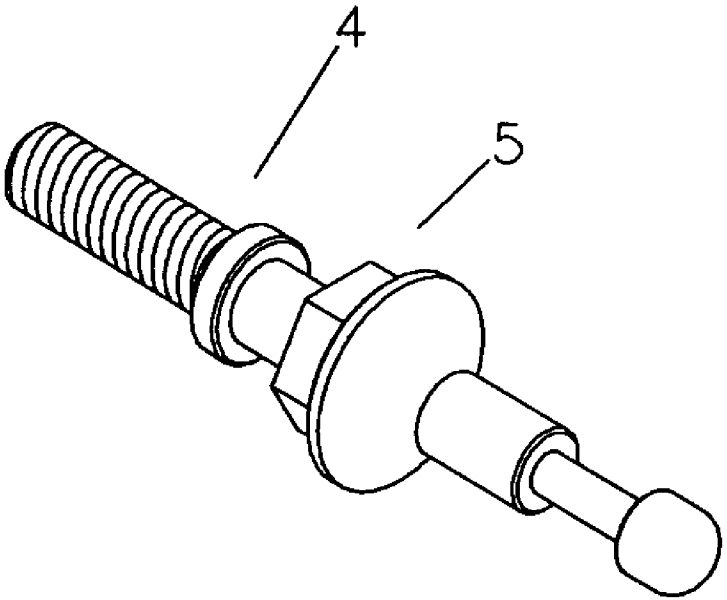
FIG. 3 is an optionally used ferrule in the invented broadhead.

FIG. 3 shows an optional ferrule 4 with tightening feature 5 which may optionally be used in the invented broadhead 1. Tightening feature 5 may be a hexagonal nut feature (as shown) or a pair of opposed flats or similar features that allow a tool to be used to apply a tightening torque encouraging engagement of threads 6 to engage threads 19 in secure assembly of the broadhead 1 to arrowshaft 2 to form arrow 20.

Figure 4:
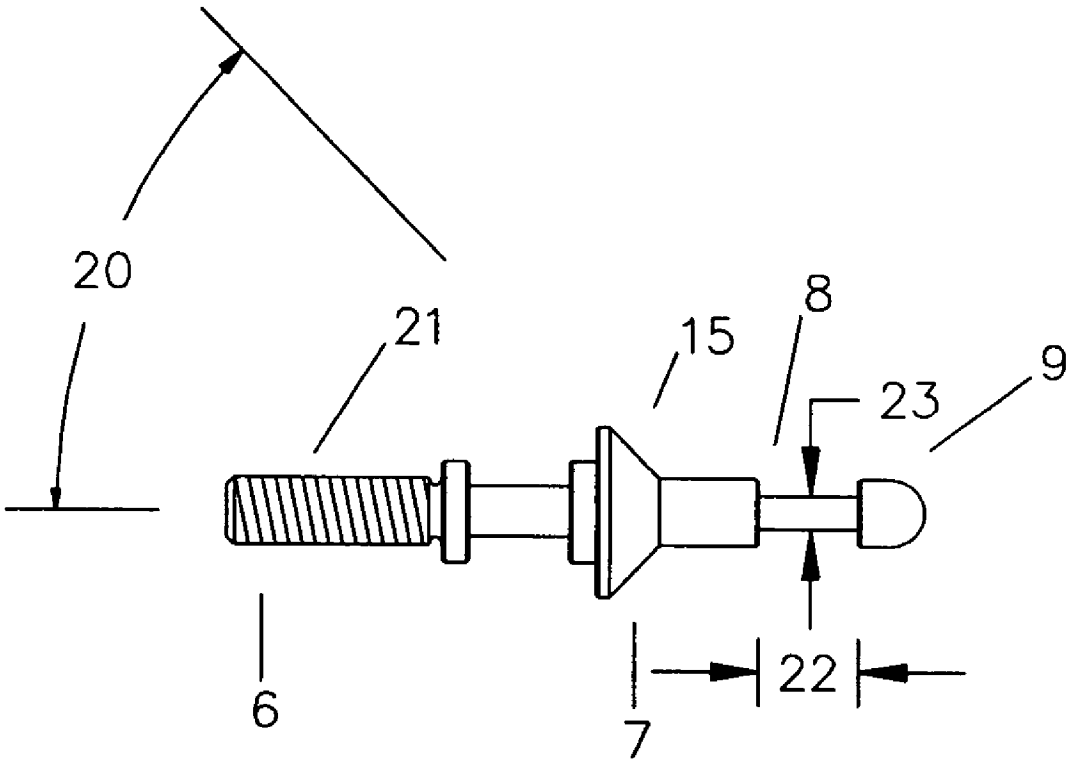
FIG. 4 is a side view of a ferrule used in the invented broadhead

FIG. 4 shows a side view of optional ferrule 21 which features cone 7 which provides a site for attachments 15. Threads 6 are shown at proximal end of ferrule 21. Cone 7 may optionally be replaced by a hemisphere (not shown). Attachments 15 are preferably laser welds as described later. We have found optimized cone angle 20 of proximal cone or sphere 7 to be preferably 30 degrees to 60 degrees, and more preferably 40 degrees to 50 degrees for best strength and flight characteristics of the broadhead. Ferrule 21 also has a shaft distal portion 8 with portion length 22 and diameter 23 which may be adjusted during ferrule fabrication to achieve the target mass for the ferrule 21. Distal cone or sphere 9 provides a site for welds 16. Distal cone or sphere 9 may vary from cone or spherical shape. For example a bullet nose or ellipsoid shape may optionally be used.

Figure 5:
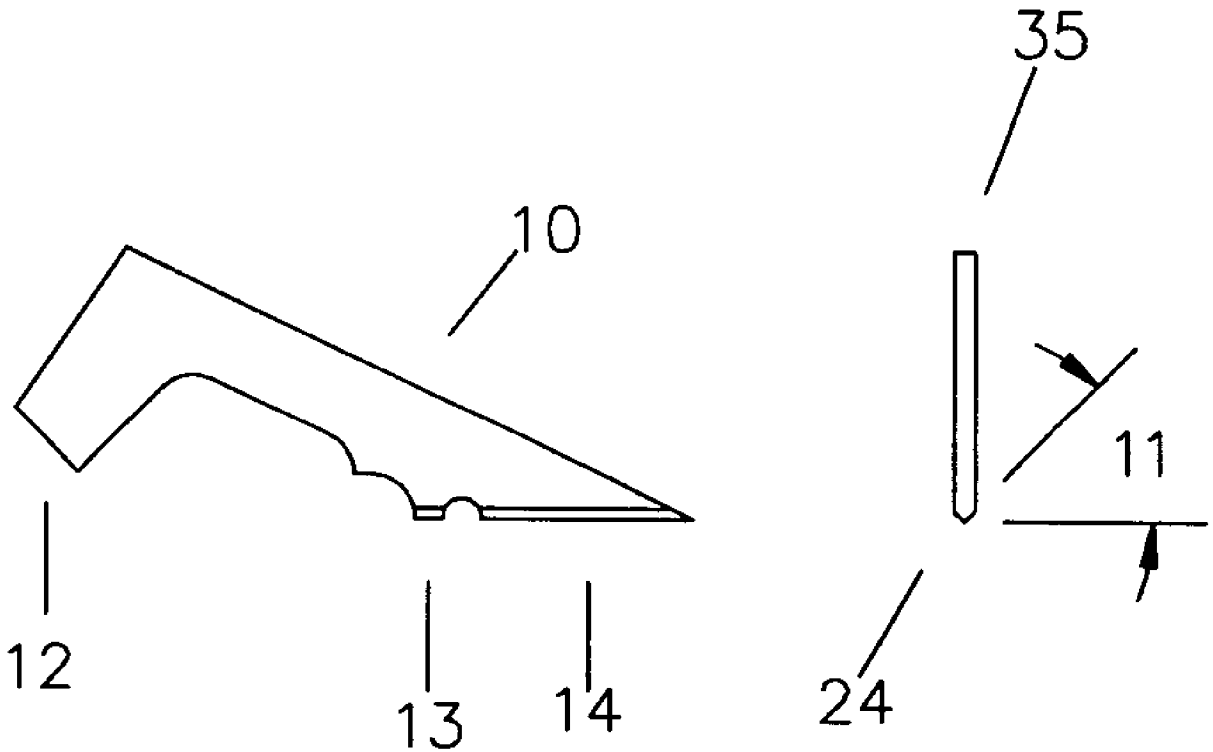
FIG. 5 is a blade of the invented broadhead.

Various alternative embodiments of the invention may use ferrules 3, 4, or 21. Blade 10 is shown in detail in FIG. 5. Blade 10 is preferably made of metal, preferably stainless steel, preferably 400 series stainless steel. In the most preferred embodiment, blade 10 is made of 420 Stainless Steel. Blade 10 includes proximal attachment zone 12, which attached to proximal cone or sphere 7 in the broadhead 1. Blade 10 also includes intermediate attachment zone 13 and distal attachment zone 14. Both intermediate attachment zone 13 and distal attachment zone 14 are preferably beveled with bevel 24 to enhance the attachment to the corresponding zones of adjacent blades 10 when assembling multiple blades 10 with ferrule 21 or ferrule 3 to fabricate broadhead 1. Bevel 24 is preferably formed by coining but can also be formed by machining and results in bevel angle 11 which is preferably about 45 degrees. Bevel 24 is coined with a coining punch (not shown) using techniques well known in the art. Any resulting flash may be trimmed off with a trimming die (not shown.) Blade edge 35 is initially formed dull and will be ground to cutting surface 36 after the blades 10 are welded to ferrule 3, 4, or 21 to form broadhead 1.

Figure 6:
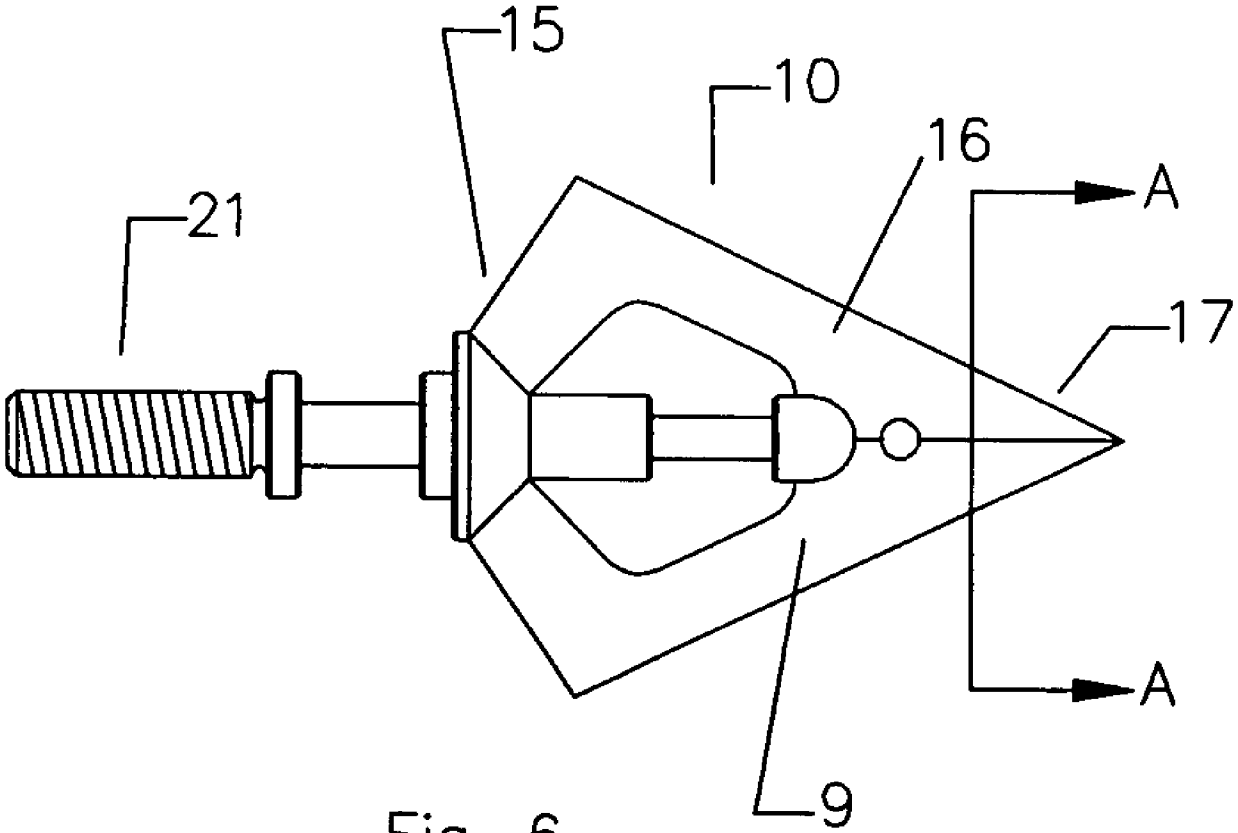
FIG. 6 is a side view of the invented broadhead

As shown in FIG. 6, blades 10 are attached to ferrule 3, preferably by laser welding, at attachment zones 15 and 16, and are attached to each other at attachment zone 17. Optionally, ferrule 3 or ferrule 4 (not shown) may be used instead of the preferred ferrule 21. At attachment zone 16, the blades 10 are preferentially welded to each other as well as to ferrule 3, ferrule 4, or ferrule 21 at distal cone or sphere 9.

Figure 7:
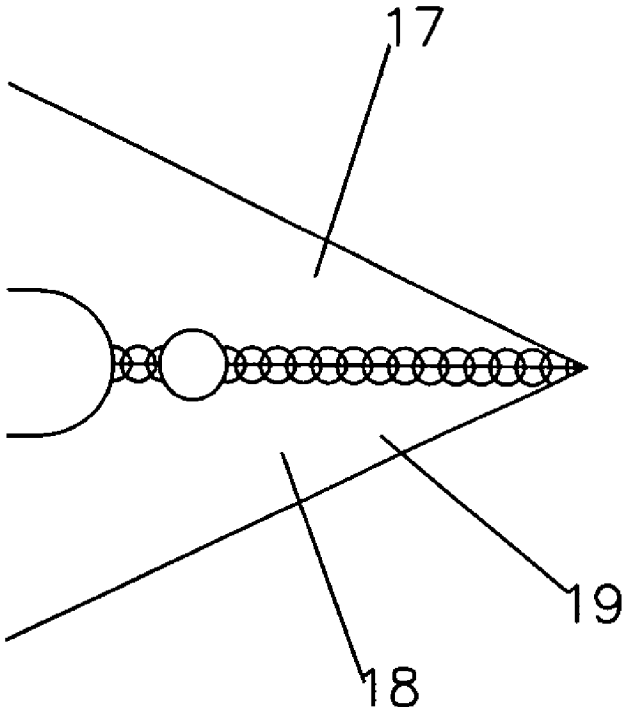
FIG. 7 is a detail of the distal end of the invented broadhead.

FIG. 7 shows a detail of attachment zone 17. The welds 18 may be spaced at intervals or preferably overlap to form a series of overlapping welds 19 that have minimum or no space between welds. Preferably, the overlap is 60 to 70 percent overlap between adjacent welds.

The same overlap is preferably applied at attachment zones 15 and 16 (detail not shown).

Figure 8A:
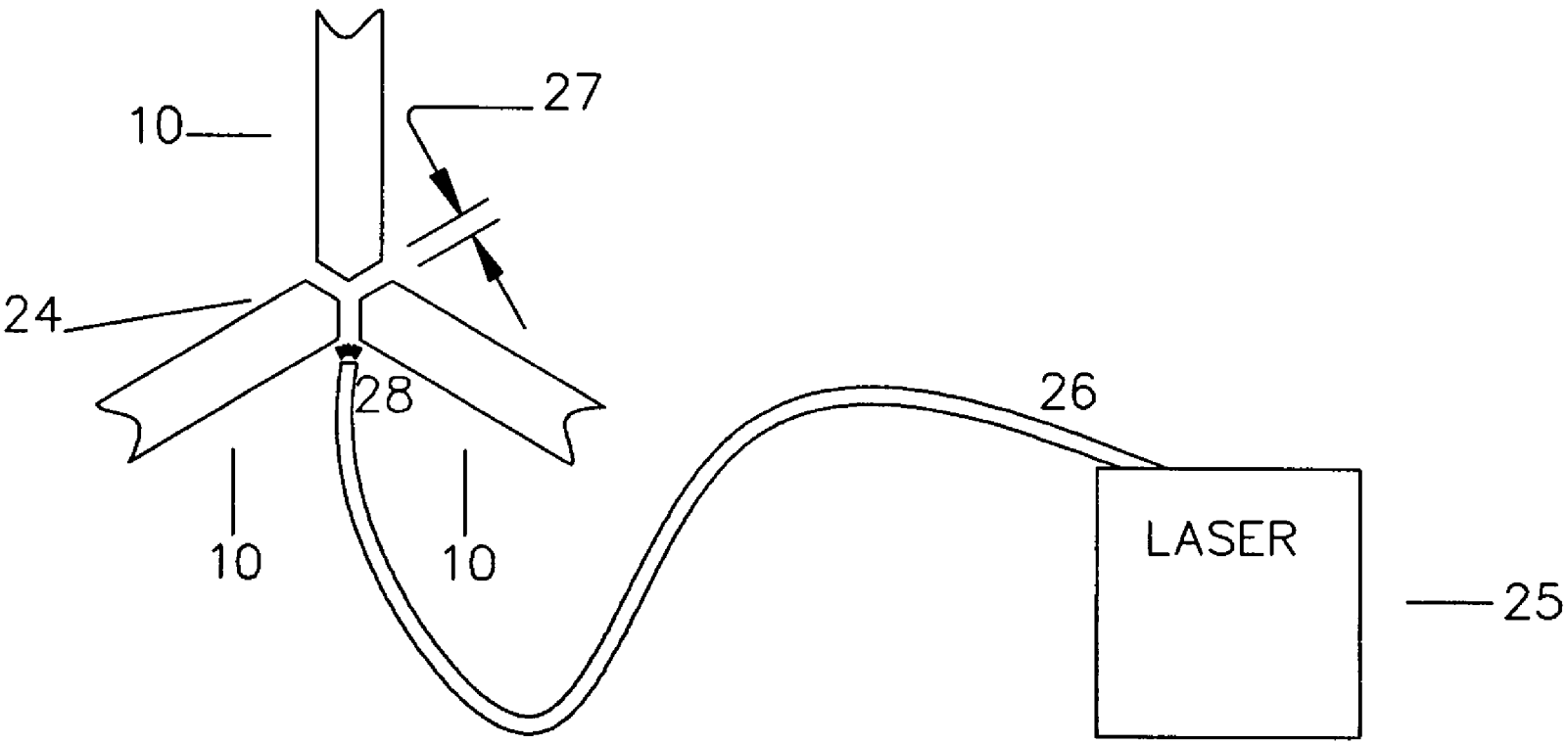
FIG. 8A is a schematic representation of the invented welding method.
Figure 8B:
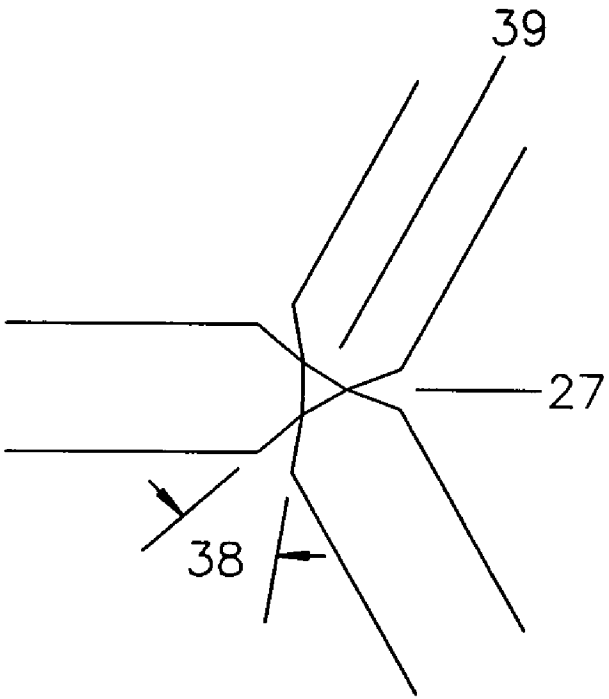
FIG. 8B shows details of the blade assembly configured prior to welding.
Figure 8C:
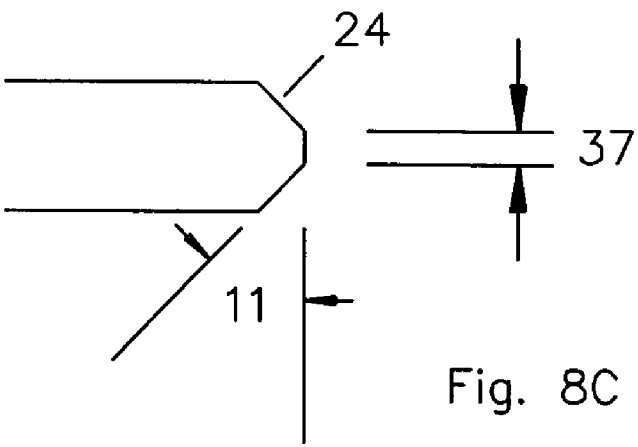
FIG. 8C shows a detail of the preferred blade bevel.

As shown in FIG. 8A, corresponding to the view A-A of FIG. 6, bevel 24 allows optimal gap 27 between the blades. In the preferred embodiment, details of which are shown in FIG. 8B, gap 27 is about 0.012 inches and weld channel angle 38 is about 30 degrees. Weld channel angle 38 permits radiant energy 28 to be applied simultaneously to gap 27 and along bevel 24 to bevel contact point 39 enhancing the strength of welds 18, or 19. These preferred dimensions are achieved when blade 10 is coined with bevel 24 chosen to be about 45 degrees and remaining unbeveled stock depth 37 (shown in FIG. 8C) is about 0.008 inches. Laser 25 applies radiant energy 28 through fiber optic lines 26 to apply radiant energy 28 to both sides of blades 10 at gap 27 to create a weld 18 (shown in FIG. 7) or series of overlapping welds 19 to blades 10.

Figure 9:
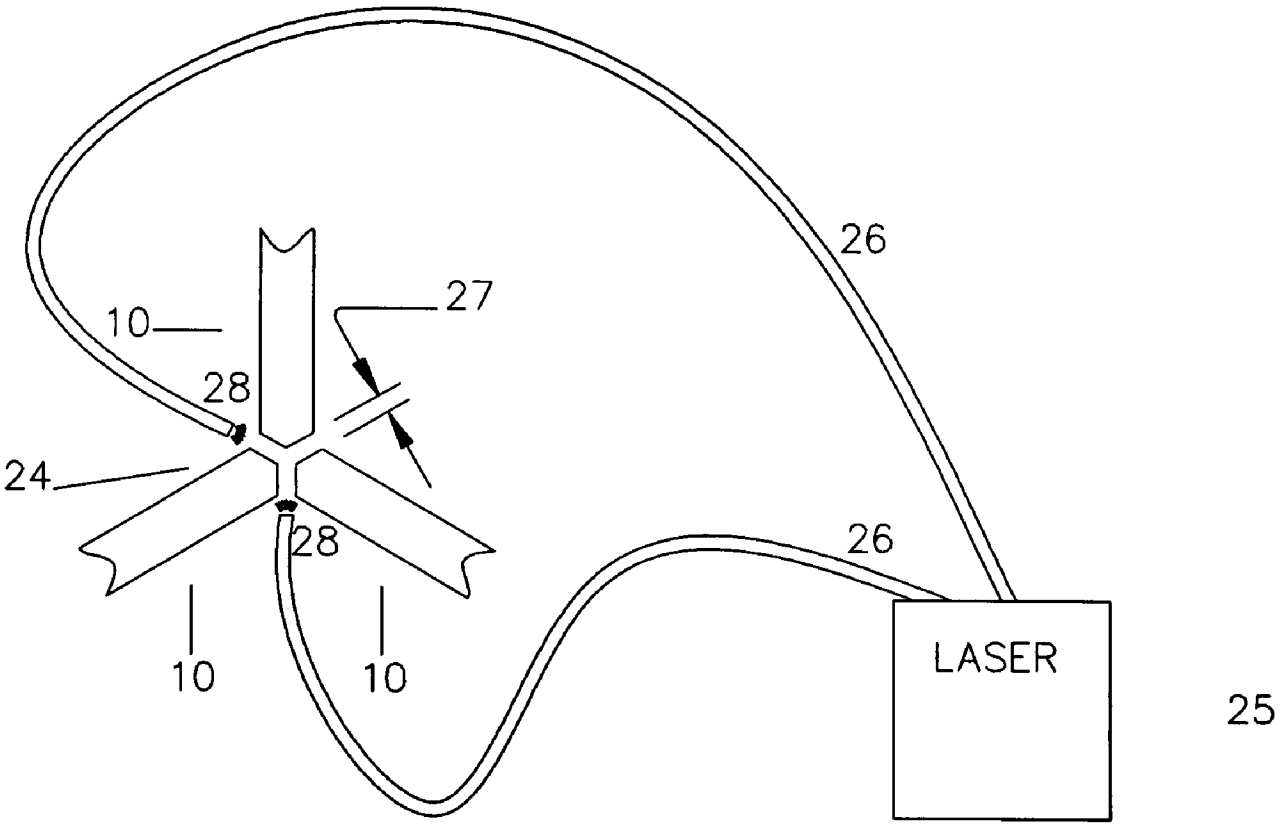
FIG. 9 is a schematic representation of an invented alternate welding method.

Optionally, as shown in FIG. 9, one or more additional fiber optic lines 26 may be employed to simultaneously apply energy 28 to both sides of blade 10 at once. The simultaneous welding is achieved in a staggered manner to avoid excessive heat buildup. In the preferred embodiment, optional simultaneous welding of both sides of blade 10 would be done at attachment zones 15, 16, and 17 by welding attachment zone 15 on one side of blade 10 while the other side of blade 10 would be simultaneously welded at attachment zone 16. Then while the first side of blade 10 is being welded at attachment zone 16, the other side would be being welded at attachment zone 17, and the first side of blade 10 is welded at attachment zone 17 while the opposite side is being welded at attachment zone 15.

Figure 10:
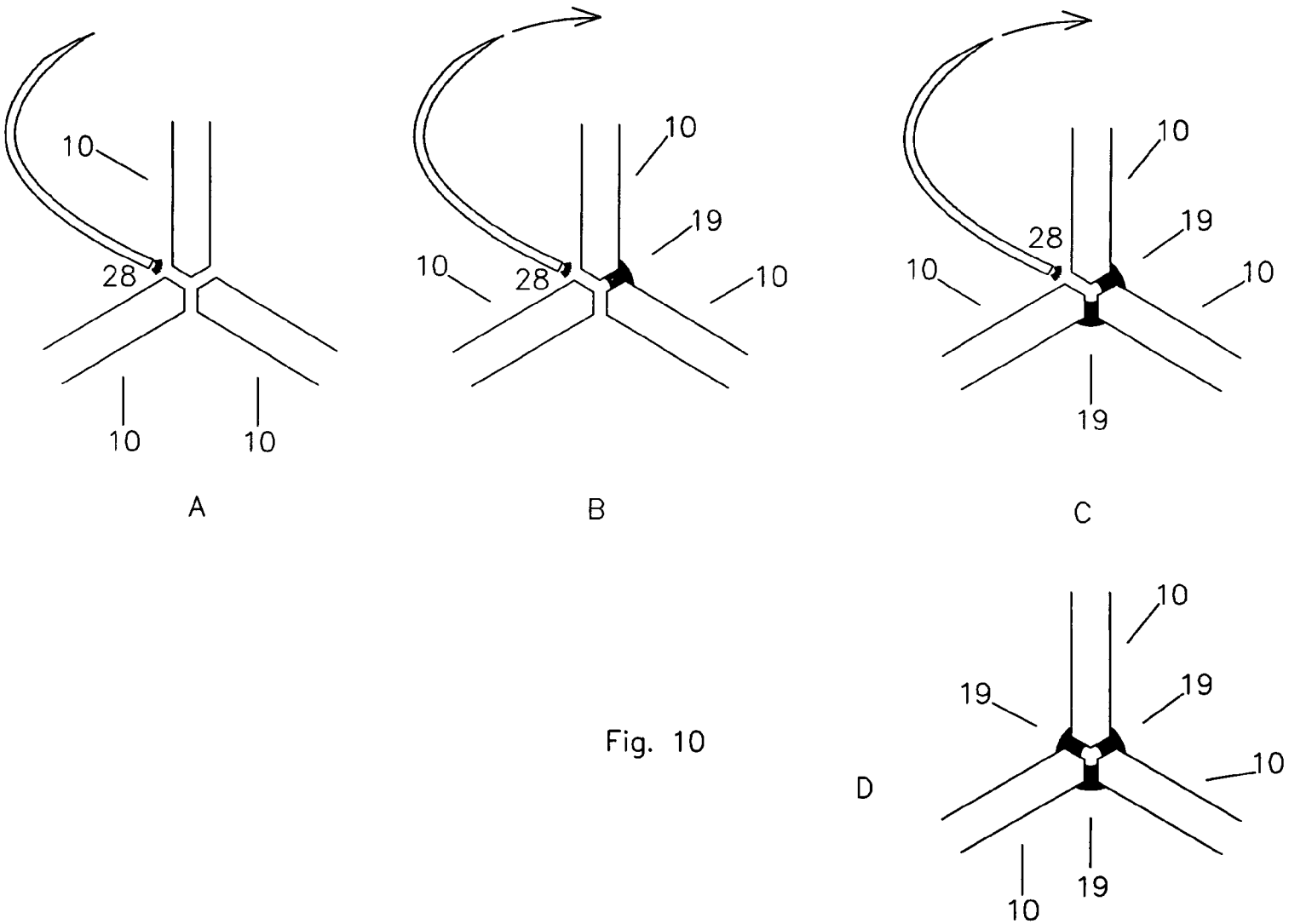
FIG. 10 is an end view illustrating the invented method.

FIG. 10 shows details of the invented method of FIG. 8 whereby the assembly of blades 10 and ferrule 21 (not shown) is mounted on a mandrel (not shown) and then welded along one line of overlapping welds 19 (FIG. 10*a*) rotated 120 degrees, welded again (FIG. 10 *b*), rotated 120 degrees, and welded (FIG. 10*c*). An end view of the welded assembly is shown in FIG. 10 *d*.

Figure 11:
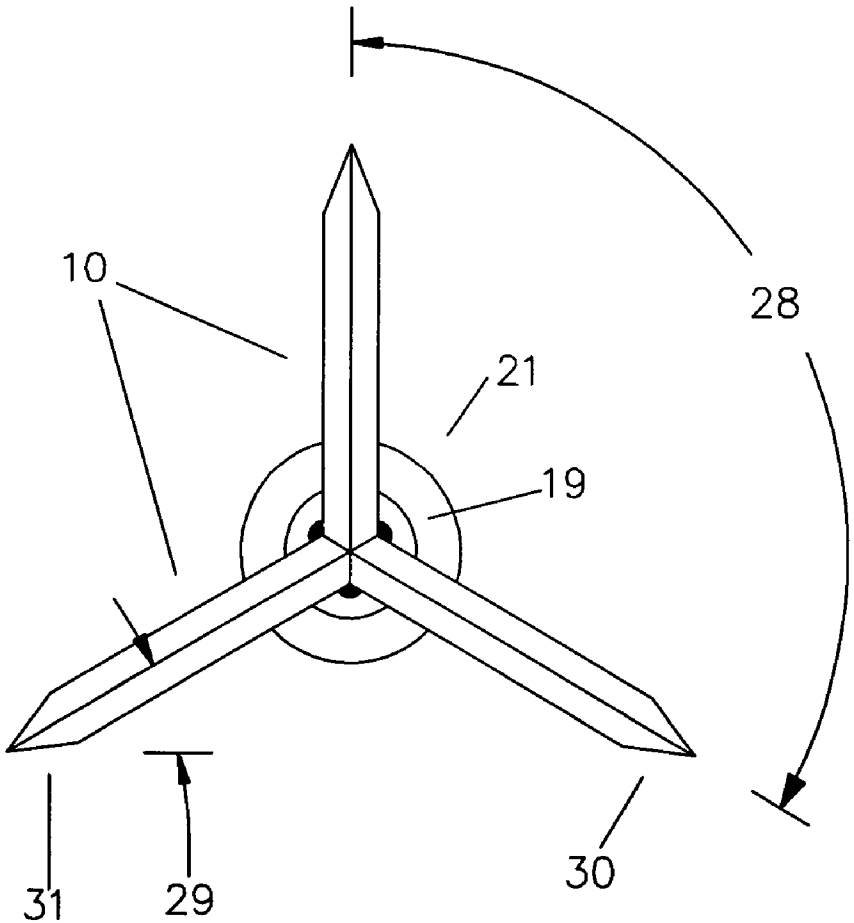
FIG. 11 is an end view of the invented broadhead

FIG. 11 shows another end view of invented broadhead 1 with angle 28 preferably 120 degrees and bevel angle 29 being preferably 30 degrees so that bevel 30 of blade 10 is thereby coplanar with bevel 31 of adjacent blade 10 thus allowing broadhead 1 to be sharpened on a flat honing stone (not shown.)

Broadhead 1 is a modular assembly of blades and ferrule portion which is easier to handle in field (hunting) conditions than a prior art assembly of numerous small easily lost pieces. There are no moving parts to lose. It may be easily sharpened in the field while mounted to the arrowshaft because the three blades are permanently deployed in a 120 degree arrangement so that each blade edge is in a plane with its adjacent blade's edge leading to ease of sharpening with a flat stone. The blades are preferably welded to the ferrule portion on both sides as seen in FIG. 10. The welded tips 17 provide mutual support resulting in a strengthened impact point 32 as well as cut on contact. Cut on contact is a design feature well known in the art and means ability to cut the target animal's flesh immediately upon impact. The impact strength is further increased by the unitary ferrule portion designed for maximum axial (impact) load support and then further being welded to the blades. The welded assembly is resistant to deformation which could result in asymmetrical flight or wobble. The ferrule portion may be selected from a different species of steel (preferably 416 SST) from that of the blades (preferably 416 or 420 SST) allowing optimum material selection choices for both.

In the method aspects of the invention, as shown in FIG. 10, the blades 10 are welded by radiant energy 28 applied by laser 25 to create welds 18 or preferably overlapping welds 19. Initially the welds are tack welds to hold the blades and ferrule in their correct alignment for further welding. FIG. 10 shows the view taken along sightline A-A in FIG. 6. In the invented method, the welds are created by a series of overlapping spot welds along gap 27. The fiber optic line 26 is passed along the length of the area to be welded, attachment zones 15, 16, and 17 in turn, applying an appropriate amount of laser energy to fuse the blades 10 together in attachment zone 17 or to fuse the blades 10 to the ferrule 3, 4, or 21 at attachment zone 15, or to both blades 10 and ferrule 3, 4, or 21 at attachment zone 16. Typically, a 1200 nM wavelength laser beam with a peak power of 3 KW with a pulse duration of 3.3 milliseconds and focused spot size of 0.025 inches is used to accomplish the laser welding. After all the welds along a series of welds are completed, the broadhead is rotated on the mandrel and the next series is welded as shown in FIG. 10*b* and repeated as shown in FIG. 10 *c*. The resulting weld series results in both sides of each blade being welded to both an adjacent blade and the ferrule.

While various dimensions in the drawings have been specifically shown, it is not intended that these dimensions be limiting in any way since many other dimensions can be used as desired.

While these embodiments of the present invention have been shown and described, it will be obvious to those skilled in the art that changes and modifications will be made without departing from the invention in its broader aspects. The aim of the appended claims is to cover all such changes and modifications as fall within the true spirit and scope of the invention.

We claim:

1. A broadhead arrow point for use with an arrowshaft in hunting and target archery, comprising:

a blade assembly portion comprising at least two blades, a ferrule portion with a threaded fastener permanently attached to the blade assembly, whereby the blade assembly portion is laser welded to the ferrule, the blades are laser welded to each other, the arrow point is attachable directly to an arrowshaft, and each individual blade comprises a blade bevel and an unbeveled stock depth.

2. The arrow point of claim 1 wherein the welds are overlapping spot welds.

3. The arrow point of claim 2 wherein the blade assembly comprises three blades.

4. The arrow point of claim 1 wherein the blades are welded to the ferrule and each other from both sides.

5. The arrow point of claim 4 wherein the ferrule portion has a male thread, and the arrow shaft has a female thread.

6. A broad head arrow point for use with an arrowshaft in hunting and target archery, comprising:

a blade assembly portion comprising at least two blades, a ferrule portion with a threaded fastener attached to the blade assembly, whereby the blade assembly portion is welded to the ferrule portion and the blades are welded to each other, the arrow point is attachable directly to an arrowshaft, and the ferrule portion comprises a tool receiving feature for applying tightening torque to the ferrule portion threads, and each individual blade comprises a blade bevel and an unbeveled stock depth.

7. A broadhead arrow point for use with an arrowshaft in hunting and target archery, comprising:

a blade assembly portion comprising three blades, a ferrule portion with a threaded fastener attached to the blade assembly portion, whereby the blade assembly portion is laser welded to the ferrule portion and the blades are laser welded to each other, the arrow point is attachable directly to an arrowshaft, and each individual blade comprises a blade bevel and an unbeveled stock depth.

8. An arrow for use with an arrowshaft in hunting and target archery, comprising:

an arrowshaft, a unitary broadhead arrow point comprising a blade assembly portion comprising at least two blades, a ferrule portion with a threaded fastener permanently attached to the blade assembly, wherein the blade assembly is laser welded to the ferrule and the blades are laser welded to each other, the arrow point is removably attached directly to the arrowshaft, and each individual blade comprises a blade bevel and an unbeveled stock depth.

9. The arrow point of claim 8 whereby the welds are overlapping spot welds.

10. The arrow point of claim 9 wherein the blade assembly comprises three blades.

11. The arrow point of claim 10 wherein the blades are welded to the ferrule and each other from both sides.

12. The arrow point of claim 11 wherein the ferrule portion has a male thread and the arrowshaft has a female thread.

13. A broad head arrow point for use with an arrowshaft in hunting and target archery, comprising:

a blade assembly portion comprising at least two blades, each of the at least two blades comprising a beveled portion and an unbeveled portion, a ferrule portion with a threaded fastener attached to the blade assembly, whereby the blade assembly portion is welded to the ferrule portion and the blades are welded to each other, and the arrow point is attachable directly to an arrowshaft.

14. The arrow point of claim 13 whereby the bevel angle is between 35 and 55 degrees.

15. The arrow point of claim 14 whereby the unbeveled portion is between 10 percent and 30 percent of the blade thickness.

16. A broadhead arrow point for use with an arrowshaft in hunting and target archery, comprising:

a blade assembly portion comprising at least two blades, a ferrule portion with a threaded fastener permanently attached to the blade assembly, whereby the blade assembly portion is laser welded to the ferrule, the blades are laser welded to each other, the arrow point is attachable directly to an arrowhead, each individual blade comprises a blade bevel and an unbeveled stock depth, and the impact load on the blades is transmitted in part by compression to the ferrule.

* * * * *